US006712510B2

(12) United States Patent
Schneider et al.

(10) Patent No.: US 6,712,510 B2
(45) Date of Patent: Mar. 30, 2004

(54) SLIDER ZIPPER PACKAGE WITH WIDE MOUTH OPENING

(75) Inventors: John H. Schneider, Frankfort, IL (US); Donald L. Crevier, Essex, IL (US); Patricia I. Norek, Manteno, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/134,220

(22) Filed: Apr. 26, 2002

(65) Prior Publication Data

US 2003/0202717 A1 Oct. 30, 2003

(51) Int. Cl.[7] ..... B65D 33/16

(52) U.S. Cl. ..... 383/64; 383/9; 383/61.2; 383/107; 383/210

(58) Field of Search ..... 383/64, 9, 210, 383/61.2, 107

(56) References Cited

U.S. PATENT DOCUMENTS 4,948,267 A * 8/1990 Kaldenbaugh ..... 383/63
5,067,822 A * 11/1991 Wirth et al. ..... 383/61.2
5,129,734 A * 7/1992 Van Erden ..... 383/61.2
5,947,603 A * 9/1999 Tilman ..... 383/64
6,357,914 B1 3/2002 Kinigakis et al.
6,461,043 B1 * 10/2002 Healy et al. ..... 383/204

* cited by examiner

*Primary Examiner*—Jes F. Pascua
(74) *Attorney, Agent, or Firm*—Pitney, Hardin, Kipp & Szuch LLP

(57) ABSTRACT

A reclosable package having a front wall (10), a rear wall (14), bottom (18), top (16), and first and second sides (20, 22). A zipper (24) extends across the package top between the sides with a slider (30) disposed along the zipper between a zipper fully open position when the slider is at the first side (20) and a fully closed position when the slider is at the second side (22). A side seal (36) on the first side (20) joins the front wall (10) to the rear wall (14) and extends between the bottom (18) and the zipper (24). The side seal (36) further extends toward the second side (22) for a distance at least as long as the length of the slider (30). When the slider (30) is in the zipper fully open position it parks above the side seal (36) and out of the mouth of the package (10) leading to a product cavity (38).

15 Claims, 3 Drawing Sheets

SLIDER ZIPPER PACKAGE WITH WIDE MOUTH OPENING

BACKGROUND OF THE INVENTION

The present invention relates to reclosable packaging such as plastic pouches or trays and, in particular, to a reclosable package (and method of making the package) with a zipper having a slider which is constructed to prevent the slider from interfering with the filling or emptying of product from the package cavity.

Reclosable packaging has gained wide acceptance both for storage purposes and as primary packaging for foodstuffs and other commodities. The reclosable closures for such packaging consists of a pair of profiles having mating interlocking elements. It is becoming increasingly popular to provide a slider on the zipper to both facilitate opening and closing the zipper and to provide a visual indication of the condition of the zipper. While adding the slider to the zipper provides advantages to the package, the slider may reduce the effective length of the package mouth by protruding into the package opening. There is also the possibility of the slider inadvertently being displaced from the zipper by a user filling or emptying the package since, even when the slider is in the fully open position, the slider tends to block a portion of the mouth of the product cavity.

SUMMARY OF THE INVENTION

The above problems of the prior art are effectively resolved in accordance with the present invention by providing an improved package that is designed so that when the slider is in the zipper fully open position, it is parked in an area to the side of the product cavity.

The package has a front wall, a rear wall, bottom, top, and first and second sides. A zipper extends across the package top between the first side and the second side. A slider is disposed for movement along the zipper between a zipper fully open position when the slider is at the first side of the package, and a zipper fully closed position when the slider is at the second side of the package. A side seal is provided at the package first side joining the front wall to the rear wall and extending between the package bottom and the zipper. The side seal further extends toward the second side of the package for a distance at least as long as the length of the slider. In this manner, when the slider is in the zipper fully open position it parks above the side seal and out of the mouth of the package leading to the package product cavity. Additionally, the side seal may curve away from the zipper to an interior edge of the side seal. By extending the side seal away from the zipper in this manner, the area between the slider and the side seal is reduced without interfering with the movement of the slider. The tapered side seal and the reduced area between the slider and the side seal reduces the possibility that the product might be stuck in the area or caught by the side seal when being inserted or removed from the package.

DETAILED DESCRIPTION OF THE PREFERRED EMBODIMENT

Figure 1:
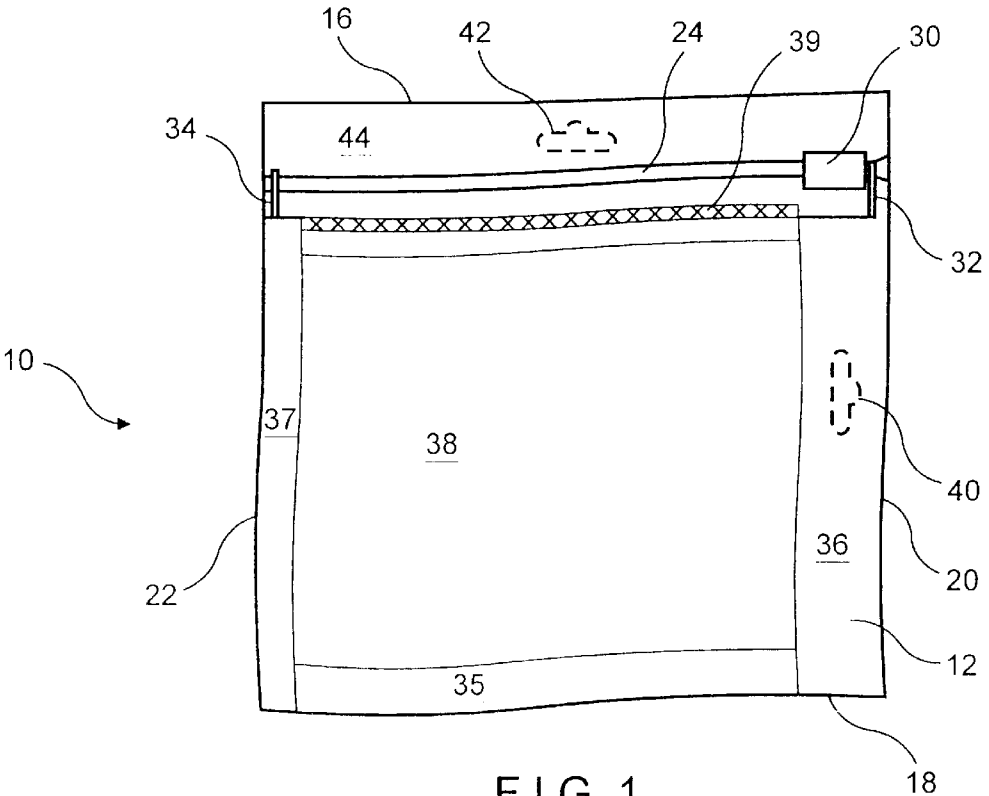
FIG. 1 is a front view of a reclosable package in accordance with the present invention.
Figure 2:
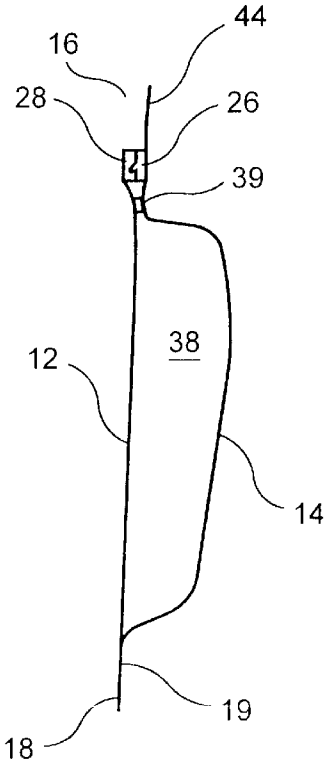
FIG. 2 is a side elevational view thereof.
Figure 3:
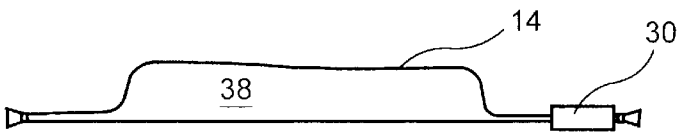
FIG. 3 is a top view thereof.

Reference is now made to the drawings wherein like numerals indicate like elements throughout the several views, wherein FIG. 1 is a front view of the reclosable package 10 of the present invention. As shown in the figure, the package 10 has a front wall 12, a rear wall 14, a top 16, a bottom 18 and opposed sides 20, 22. A zipper 24 having mating interlocking members 26, 28 extends across the top 16 of the bag from the side 20 to the side 22. A slider 30 is mounted on the zipper 24 to facilitate opening and closing the package 10. When moved toward the side 20, the slider 30 serves to disengage the interlocking members 26, 28; and when moved toward the side 22 the slider brings the interlocking members into engagement. End stops 32, 34 are provided at the ends of the zipper 24 to maintain the slider 30 on the zipper.

The front wall 12 of the package is sealed to the rear wall 14 of the package at the package bottom 18 by a seal 35 and is sealed at the package sides 20, 22 by side seals 36, 37. A product cavity 38 is formed in the rear wall surrounded by seals 35, 36, and 37. A peel seal 39 extends across the package below the zipper 24 to provide tamper evidence and/or to permit the package cavity 38 to be hermetically sealed. The side seals 36, 37 include narrowed portions that extend to stops 32, 34 so as to provide continuous side seals from the package bottom 18 to the zipper 24.

In accordance with the present invention the side seal 36, which is at the zipper fully open side of the package, is formed wider than the length of slider 30. As a result, when the slider is in the zipper fully open position it parks above seal 36 and out of the package mouth. That is, the slider parks totally to the side of the product cavity 38 and hence permits unencumbered access to and from the product cavity. The side seal 36 is sufficiently wide to accept a hang hole 40. Alternatively a hang hole 42 (shown in phantom) may be provided in header 44 formed by a portion of the rear wall 14 that extends above the top of the front wall 12.

Figure 4:
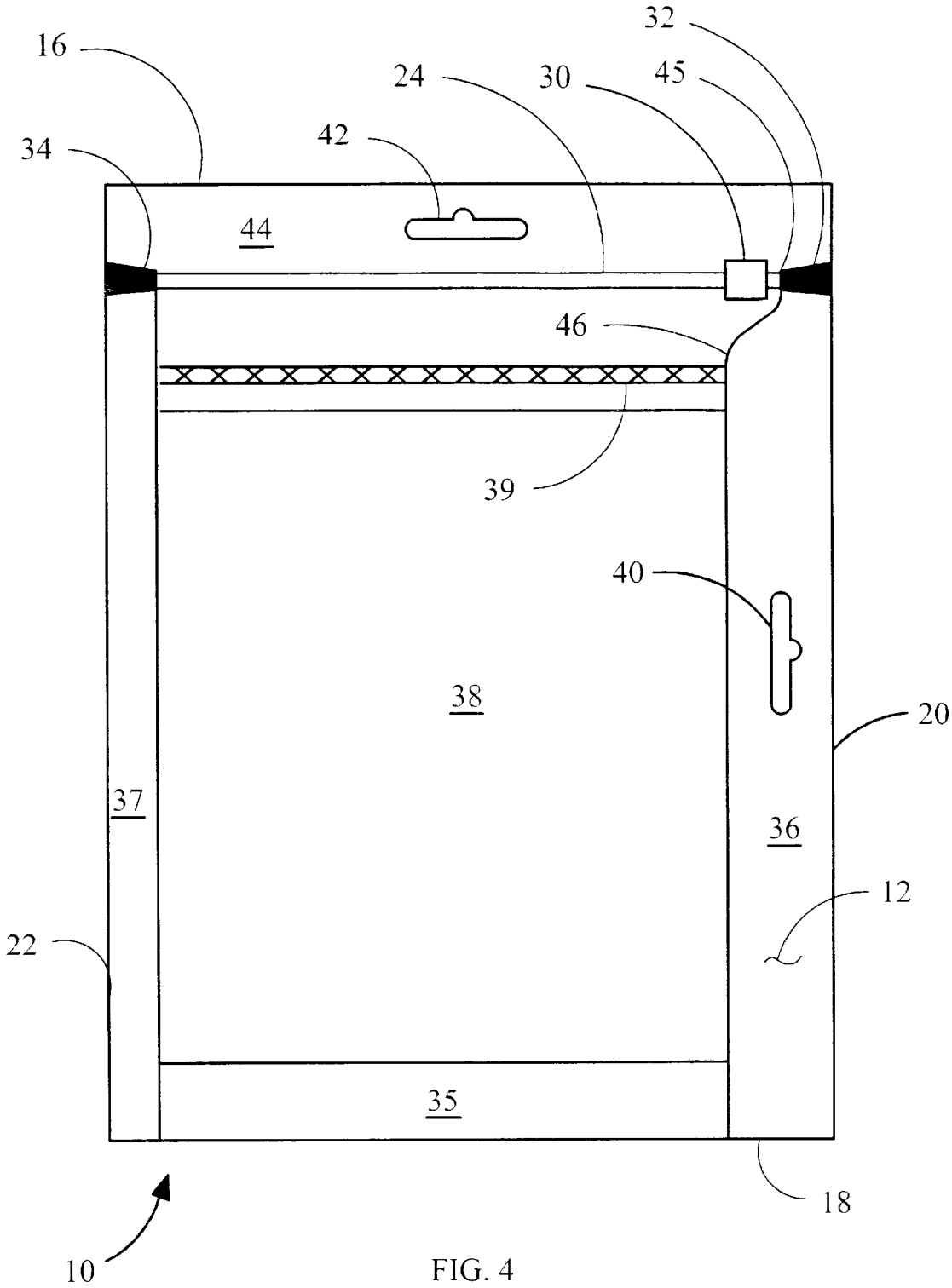
FIG. 4 is a front view of a reclosable package in accordance with a second embodiment of the present invention.

In a further embodiment, the side seal 36 may be tapered in the parked area of the slider 30. As shown in FIG. 4, the side seal 36 curves from a slider contact end 46 to an interior edge 45. By extending the side seal 36 away from the zipper 24 in this manner, the area between the slider 30 and the side seal 36 is reduced without interfering with the movement of the slider. The tapered side seal 36 and the reduced area between the slider 30 and the side seal reduces the possibility that a product might be stuck in the area or caught by the side seal when the product is inserted or removed from the package 10.

Figure 5:
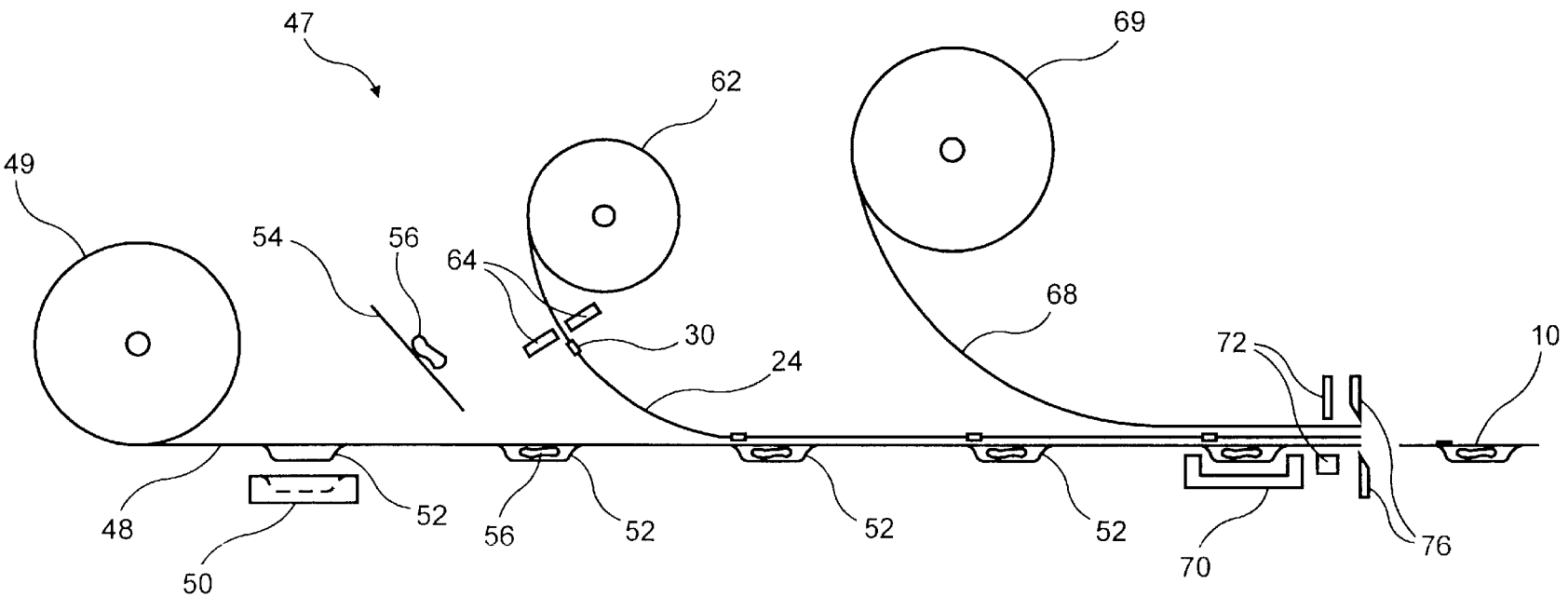
FIG. 5 is a schematic view of a representative manufacturing method.

A representative method of forming the package 10 on a form, fill and seal machine 47 is shown schematically in FIG. 5. A base film 48 of thermoformable material for the package rear wall is fed from a supply spool 49 past a thermoforming station 50 where spaced pockets 52 are formed. As the formed film progresses, product 56 is fed through hopper 54 into each pocket. A zipper 24 having sliders 30 attached at spaced intervals is fed onto the base film from spool 62. The zipper 24 may already be pre-shaped and crimped on the spool, or the zipper may be shaped and crimped at station 64 before it is applied to the base film. The shaping and crimping serves to flatten the ends of each length of zipper 24 so as not to interfere with the sealing of the zipper to the base and top films and to form the end stops 32, 34, shown in FIGS. 1 and 4. A top film 68 for the package front wall is then fed from spool 69 over the base film 48, capturing the zipper 24 between the top film and the base film. The films 48, 68 and the zipper 24 are then fed to a sealing station 70 where the side seals 36, 37 and the bottom seal 35 are formed by sealing the top and bottom films and the zipper is sealed to the films. At the same time the peel seal 39 may be formed between the zipper 24 and the product cavity 38 and air may be evacuated from the product cavity if desired. The individual sealed packages 10 are then removed by cutter 76 and any required hang holes are formed by punch 72.

It should be apparent that packages in accordance with the present invention may be made by numerous other processes, either as part of a filling process or empty, and that the present invention is not limited to any particular method of manufacturing. What is important to the present invention is that the side seal at the zipper open side of the package be made sufficiently wide so as to permit the zipper slider to park over the side seal when the zipper is open. In that way, when the package is open the slider rests adjacent the product cavity of the package and does not protrude into the mouth of the package leading to the product cavity.

Having thus described the invention, what is claimed is:

1. A reclosable package comprising:

a front wall, a rear wall, a package bottom, a package top, a first side and a second side;

a zipper extending across said package top between said first side and said second side;

a slider disposed for movement along said zipper between a zipper fully open position when said slider is at said first side and a zipper fully closed position when said slider is at said second side; and a first side seal at said package first side joining said front wall to said rear wall and extending between said package bottom and said zipper, said first side seal extending toward said second side for a distance at least as long as the length of said slider, whereby when said slider is in the zipper fully open position it parks above said first side seal, wherein said first side seal extends said distance to said second side by directing away from said zipper to form an increasing area between said zipper and said first side seal.

2. The reclosable package in accordance with claim 1 wherein the portion of said side seal within said extended distance includes a curved edge facing said zipper.

3. The reclosable package in accordance with claim 1 further comprising a hang hole formed in said side seal.

4. The reclosable package in accordance with claim 1 further comprising an end stop at each end of the zipper.

5. The reclosable package in accordance with claim 1 wherein at least one of said front wall and said rear wall includes a header portion extending above said zipper.

6. The reclosable package in accordance with claim 5 further comprising a hang hole in said header portion.

7. The reclosable package in accordance with claim 1 further comprising a product cavity formed in said rear wall between said side seal and said package second side.

8. The reclosable package in accordance with claim 7 wherein said package rear wall is formed of a thermoformable material.

9. The reclosable package in accordance with claim 8 further comprising a peel seal above said product cavity extending between said side seal and said package second side and joining said front wall to said rear wall.

10. A method of forming a mouth for a reclosable package comprising the steps of:

forming a package having a front wall, a rear wall, a package bottom, a package top, a first side and a second side, a zipper extending across said package top between said first side and said second side and a slider disposed for movement alone said zipper between a zipper fully open position when said slider is at said first side and a zipper fully closed position when said slider is at said second side; and joining said front wall to said rear wall at said package first side by a side seal extending between said package bottom and said zipper, said side seal extending toward said second side for a distance at least as long as the length of said slider; whereby when said slider is in the zipper fully open position it parks above said side seal, wherein said side seal extends said distance to said second side by directing away from said zipper to form an increasing area between said zipper and said side seal.

11. The method in accordance with claim 10 comprising the further step of forming a hang hole in said side seal.

12. The method in accordance with claim 10 further comprising the step of forming end stops at the ends of said zipper.

13. The method in accordance with claim 10 wherein at least one of said front wall and said rear wall include a portion extending above said zipper, further comprising the step of forming a hang hole in said top seal.

14. The method in accordance with claim 10 wherein said rear wall is formed of a thermoformable material and comprising the further step of thermoforming a product cavity in said rear wall, said side seal being disposed adjacent to said cavity.

15. The method in accordance with claim 14, comprising the further step of joining said front wall to said rear wall with a peel above said product cavity extending between said side seal and said second side.

* * * * *